US009643413B2

(12) United States Patent
Teraji

(10) Patent No.: US 9,643,413 B2
(45) Date of Patent: May 9, 2017

(54) PRINTING APPARATUS AND LEAKAGE DETECTION METHOD OF THE SAME

(71) Applicant: CANON KABUSHIKI KAISHA, Tokyo (JP)

(72) Inventor: Tomoya Teraji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/662,689

(22) Filed: Mar. 19, 2015

(65) Prior Publication Data

US 2015/0273822 A1 Oct. 1, 2015

(30) Foreign Application Priority Data

Mar. 26, 2014 (JP) ..... 2014-064349

(51) Int. Cl.
*B41J 29/38* (2006.01)
*B41J 2/045* (2006.01)

(52) U.S. Cl.
CPC ..... *B41J 2/04586* (2013.01); *B41J 2/0451* (2013.01); *B41J 2/04528* (2013.01); *B41J 2/04541* (2013.01); *B41J 2/04548* (2013.01)

(58) Field of Classification Search
CPC .. B41J 2/0458; B41J 2/04548; B41J 2/14072; B41J 2/04573; B41J 2/0457; B41J 2/04528; B41J 2/04586
USPC ..... 347/5, 9, 10, 19, 50, 57
See application file for complete search history.

(56) References Cited

U.S. PATENT DOCUMENTS

| | | | | |
|---|---|---|---|---|
| 7,350,891 | B2 | 4/2008 | Oomura et al. | |
| 2012/0249672 | A1* | 10/2012 | Inoue | 347/32 |
| 2013/0194325 | A1* | 8/2013 | Teraji | 347/6 |
| 2014/0152736 | A1* | 6/2014 | Yokozawa | 347/19 |

FOREIGN PATENT DOCUMENTS

JP 2005-305966 A 11/2005

* cited by examiner

*Primary Examiner* — Jannelle M Lebron
(74) *Attorney, Agent, or Firm* — Fitzpatrick, Cella, Harper & Scinto

(57) ABSTRACT

An embodiment of this invention is directed to a leakage detection of a printhead. The embodiment executes leakage detection as follows in a printing apparatus which uses a reciprocally movable printhead. That is, the embodiment monitors a voltage appearing on a second power line which supplies, to the printhead, a second voltage that is used for detecting the current leakage from the printhead and is lower than a first voltage to be supplied to perform printing by the printhead through a first power line to which a capacitor is parallel-connected. If a timing at which detection of the current leakage is executed is detected, the embodiment performs control so as to execute detection of the current leakage based on the monitored voltage, by turning off supply of the first voltage and turning on supply of the second voltage.

11 Claims, 10 Drawing Sheets

PRINTING APPARATUS AND LEAKAGE DETECTION METHOD OF THE SAME

BACKGROUND OF THE INVENTION

Field of the Invention

The present invention relates to a printing apparatus and leakage detection method, and particularly to a printing apparatus in which a printhead is attached to a carriage and printing is performed by the printhead while the carriage is reciprocally moved, and a leakage detection method of the apparatus.

Description of the Related Art

In a printing apparatus in which a printhead mounted on a carriage is exchangeable by the user, the printhead deteriorates with time when it has been used for a long term, so an internal circuit of the printhead malfunctions, and a current leakage occurs from a head voltage supply line. Consequently, a print failure occurs. To detect this leakage, a function called leakage detection can be used. By this leakage detection, it is possible to detect a failure of the printhead, notify the user of the failure, and prompt the user to exchange the printhead. As a result, a print failure can be prevented. As disclosed in, for example, Japanese Patent Laid-Open No. 2005-305966, the conventional leakage detection uses an arrangement in which power to be used in normal printing and power to be used in leakage detection are supplied through the same power supply line.

Since, however, the conventional leakage detection uses the same power source as that used for normal printing, the detection requires a time for charging electricity to a large capacitor formed to stabilize the voltage in the same manner as that for normal printing. This prolongs the time necessary for leakage detection.

During a printing operation in which a load is applied on the printhead, therefore, performing time-consuming leakage detection is unrealistic from the viewpoint of throughput. Accordingly, no related art explicitly discloses a means or sequence for detecting an abnormal state progressing in the printhead during a printing operation. Also, no publication pertaining to the conventional leakage detection explicitly specifies the activation timing of leakage detection as a printing apparatus.

SUMMARY OF THE INVENTION

Accordingly, the present invention is conceived as a response to the above-described disadvantages of the conventional art.

For example, a printing apparatus and its leakage detection method according to this invention are capable of rapidly and safely performing printhead leakage detection at an appropriate timing.

According to one aspect of the present invention, there is provided a printing apparatus comprising: a carriage on which a printhead is mounted; a supply unit configured to supply, to the printhead, one of a first voltage which is used to perform printing by the printhead through a first power line to which a capacitor is parallel-connected, and a second voltage which is used to detect a current leakage from the printhead through a second power line and lower than the first voltage; a monitor unit configured to monitor a voltage appearing on the second power line; a detection unit configured to detect a timing at which detection of the current leakage is executed; and a control unit configured to, in a case where the detection unit detects the timing at which detection of the current leakage is executed, turn off supply of the first voltage by the supply unit, turn on supply of the second voltage by the supply unit, and execute detection of the current leakage based on the voltage monitored by the monitor unit.

According to another aspect of the present invention, there is provided a leak detection method of a printing apparatus including a carriage on which a printhead is mounted, comprising: monitoring a voltage appearing on a second power line which supplies, to the printhead, a second voltage which is used to detect a current leakage from the printhead and lower than a first voltage which is supplied to perform printing by the printhead through a first power line to which a capacitor is parallel-connected; detecting a timing at which detection of the current leakage is executed; and in a case where the timing at which detection of the current leakage is executed is detected, controlling execution of detection of the current leakage based on the monitored voltage, by turning off supply of the first voltage and turning on supply of the second voltage.

The invention is particularly advantageous since printhead leakage detection can rapidly and safely be performed at an appropriate timing.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings. However, the scope of the invention is not limited to the relative layout and the like of constituent elements described in the embodiments unless otherwise specified.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

In addition, "a printing element" is a general term for a nozzle (or orifice), a channel communicating with the nozzle, and a device for generating energy to be used to discharge ink, unless otherwise specified.

<Overall Outline of Printing Apparatus (FIG. 1)>

Figure 1:
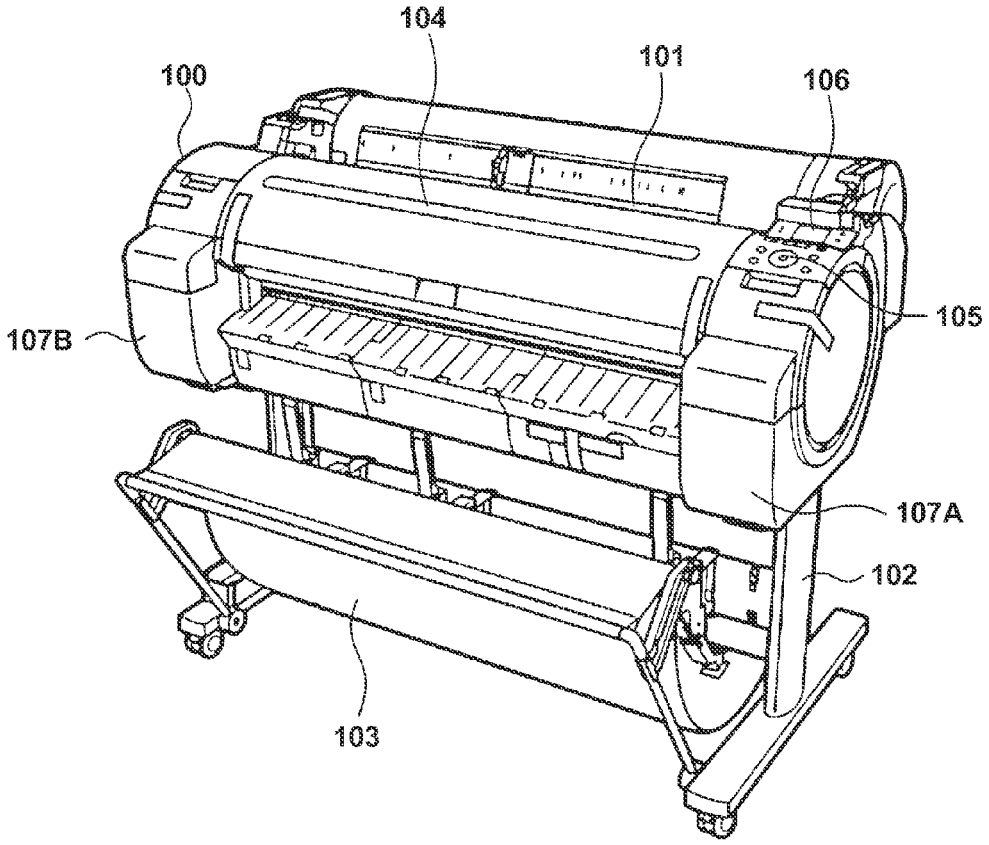
FIG. 1 is an external perspective view of a printing apparatus using an A0- or B0-size print medium as an exemplary embodiment of the present invention.

FIG. 1 is an external perspective view of an inkjet printing apparatus (to be referred to as a printing apparatus hereinafter) using an A0- or B0-size print medium as an exemplary embodiment of the present invention.

As shown in FIG. 1, a print medium such as print paper can be set on the back surface of the upper stage of a printing apparatus 100, and is supplied inside the printing apparatus from an insertion port 101 which is common to both manually fed paper and rolled paper. The printing apparatus 100 is supported on a printer stand 102 including two legs, and includes a paper discharge tray 103 for stacking discharged print media, and an openable see-through, upper cover 104. Also, an operation panel 105 and a display panel 106 for providing the user with information are arranged on the right side of the apparatus main body. In addition, ink supply units 107A and 107B are installed on the two sides of the apparatus main body, and an ink tank is placed in each of ink supply units 107A and 107B.

Figure 2:
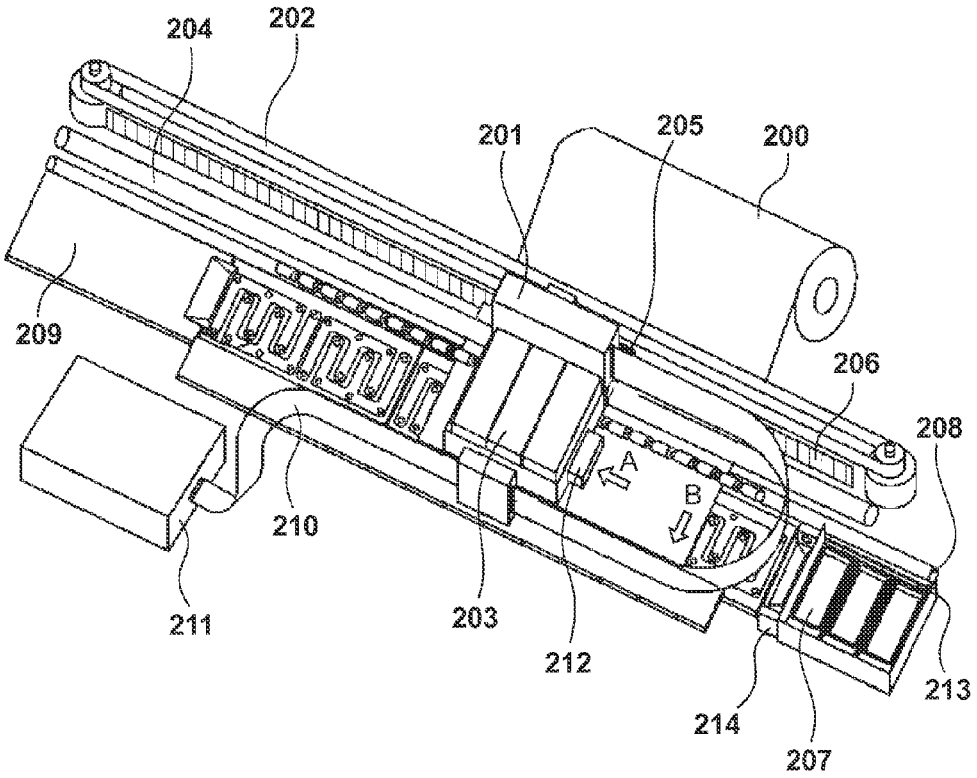
FIG. 2 is a schematic view of the interior of the printing apparatus shown in FIG. 1.

FIG. 2 is a view in which the interior of the printing apparatus main body from which the upper cover 104 of the printing apparatus shown in FIG. 1 is removed is viewed from above.

The printing apparatus includes a conveyance roller 208 for conveying a print medium 200 in an arrow B direction (sub scan direction), and a carriage unit 201 guided to be reciprocally movable in the widthwise direction of the print medium (an arrow A direction, a main scan direction). The printing apparatus further includes a carriage motor (not shown) for reciprocally moving the carriage unit 201 in the arrow A direction, a carriage belt 202, and an inkjet printhead (to be referred to as a printhead) 203 attached to the carriage unit 201. The carriage unit 201 is supported by a main shaft 204 extending in the moving direction of the carrier unit 201. The position of the carriage unit 201 can be detected by sensing slits formed in a linear scale 206 by an encoder sensor 205 mounted on the carriage unit 201.

The printing apparatus further includes a recovery unit 207 for resolving an ink discharge failure caused by, for example, clogging of an orifice of the printhead 203. Note that the printhead 203 is detachable from the carriage unit 201, and hence can be reattached if the printhead 203 is not correctly attached to the carriage unit 201, and replaced with a new printhead.

In the printing apparatus shown in FIG. 2, one printhead 203 is mounted on the carriage unit 201, and ink components of five colors are supplied to the printhead 203. That is, for example, BK (black) ink, MBK (matte black) ink, Y (yellow) ink, M (magenta) ink, and C (cyan) ink are supplied to the printhead 203.

When performing printing on the print medium 200 which may be print paper in the above arrangement, the conveyance roller 208 conveys the print medium 200 to a predetermined printing start position of a platen 209. After that, printing is performed on the whole print medium 200 by repeating an operation of moving the printhead 203 in the main scan direction by the carriage unit 201 and an operation of conveying the print medium 200 in the sub scan direction by the conveyance roller 208.

Next, the operation of the printing apparatus main body during a printing operation will be explained.

The carriage unit 201 moves in the arrow A direction shown in FIG. 2 by the carriage belt 202 and the carriage motor (not shown), thereby performing forward printing on the print medium. Then, the carriage unit 201 moves by the width of the print medium and comes to a reversal position (back position) of the carriage unit 201, and the conveyance roller 208 conveys the print medium 200 in the sub scan direction (arrow B direction). After that, backward printing is performed by moving the carriage unit 201 again in the direction opposite to the arrow A direction. When the carriage unit 201 has moved to an initial position (home position), printing of, for example, images and characters by one reciprocal movement on the print medium 200 is complete. When printing of one print medium is completed by repeating the above-mentioned operation, the print medium is discharged to the paper discharge tray 103, so printing of one print paper is complete.

The carriage unit 201 is electrically connected to a main substrate 211 by a flat cable 210, and the printing apparatus supplies power to the printhead 203 and controls the printhead 203 through the flat cable 210, or performs position sensing by the encoder sensor 205. An optical sensor 212 is mounted on the carriage unit 201. The optical sensor 212 is used to, for example, discriminate the type of print paper, sense the distance between the printhead 203 and print medium 200, or sense a jam during a printing operation to the print medium 200.

Also, this printing apparatus performs a cleaning operation on the printhead 203 in order to resolve an ink discharge failure of the printhead 203 at a predetermined timing. In this cleaning operation, the printhead 203 is capped on the recovery unit 207, and ink in the printhead 203 is sucked by using a negative pressure generated by a pump motor (not shown), thereby resolving clogging of a nozzle. The cleaning operation is executed at a predetermined timing, for example, before the start of printing, after the end of printing, or at the time of activation of the printing apparatus. Also, when a new printhead is installed, ink refill to the printhead is performed by using the negative pressure generated by the pump motor. The recovery unit 207 includes a wiper 213, and the wiper 213 performs a wiping operation by reciprocally moving in the arrow B direction while the printhead 203 is capped during the cleaning operation, thereby cleaning the ink orifice surface of the printhead 203.

The printing apparatus incorporates a discharge failure sensor unit 214 including a sensor (not shown) for detecting an ink discharge failure from the printhead 203. The discharge failure sensor unit 214 is used in a discharge failure detection sequence to be executed before or after the cleaning operation or after ink refill to the printhead 203 is performed. In this discharge failure detection sequence, a predetermined nozzle of the printhead 203 attempts to discharge ink toward the discharge failure sensor unit 214, and the presence/absence of ink discharge is sensed. In accordance with the sensing result, a discharge failure nozzle is determined, or whether ink refill to the printhead is complete is determined.

Figure 3:
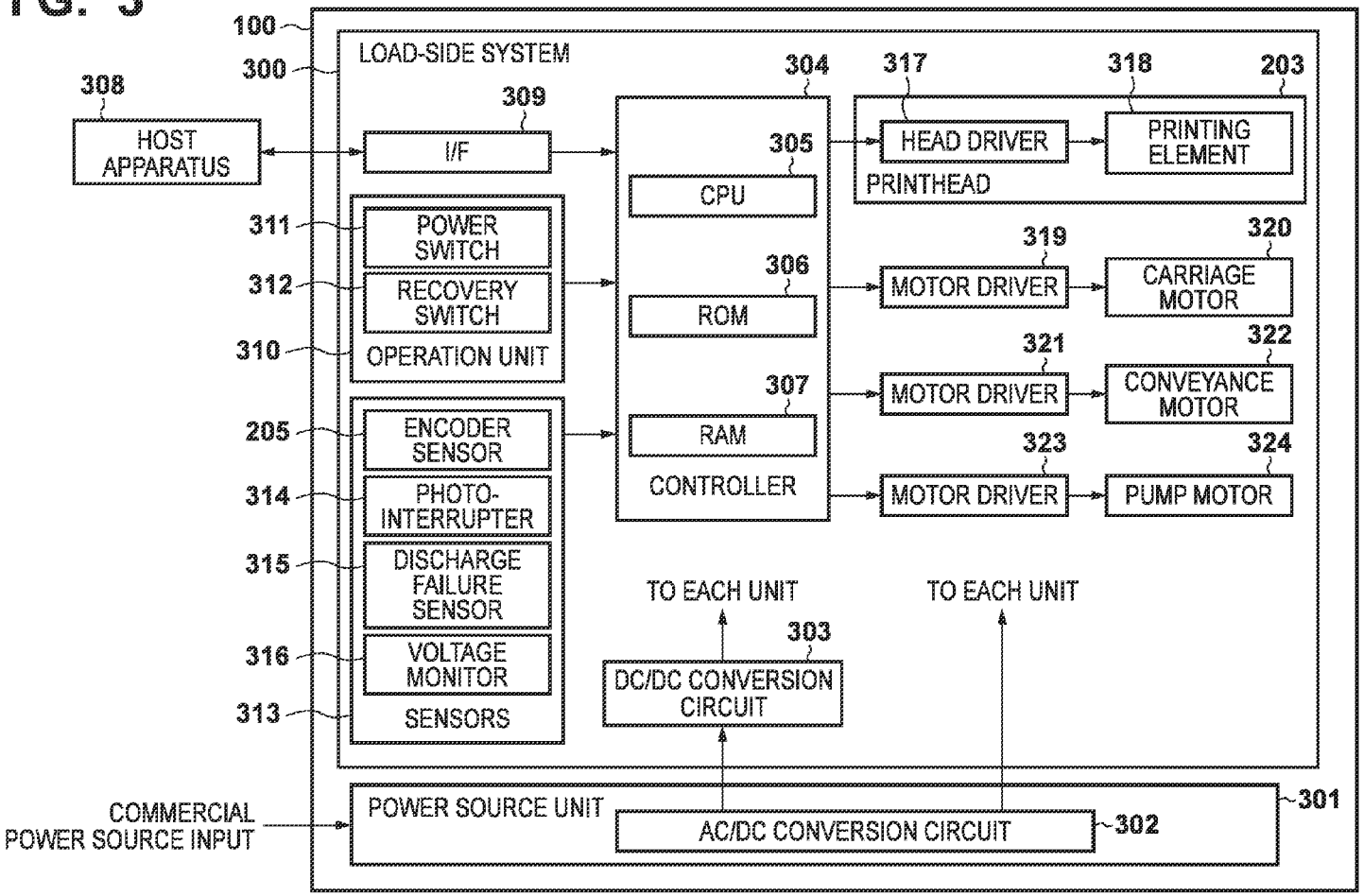
FIG. 3 is a block diagram showing a control configuration of the printing apparatus shown in FIG. 1.

FIG. 3 is a block diagram showing the control configuration of the printing apparatus shown in FIGS. 1 and 2.

The printing apparatus 100 includes a load-side system 300 and power source unit 301. The load-side system 300 and power source unit 301 are electrically connected by using, for example, a connector or cable (not shown). The power source unit 301 includes an AC/DC conversion circuit 302, and is connected to a commercial power source. The power source unit 301 outputs a predetermined voltage from the commercial power source via the AC/DC conversion circuit 302, and supplies electric power to the load-side system 300.

On the other hand, a DC/DC conversion circuit 303 of the load-side system 300 has a function of converting the DC output voltage from the AC/DC conversion circuit 302 into a predetermined DC voltage necessary for each block in the load-side system 300, outputting the converted voltage, and distributing the output voltage. The DC/DC conversion circuit 303 includes a switching regulator and its peripheral circuit.

A controller 304 includes a CPU 305 such as a microcomputer, a ROM 306 storing programs, necessary tables, and other fixed data, and a RAM 307 including an area for mapping image data and a work area. A host apparatus 308 is an image data supply source connected outside the printing apparatus. The host apparatus 308 can be a computer for forming and processing image data, and may also be an image reading apparatus (scanner) or digital camera. Image data, commands, status signals, and the like are exchanged between the host apparatus 308 and controller 304 via an interface (I/F) 309.

An operation unit 310 includes switches for accepting instruction inputs by an operator, that is, includes a power switch 311, and a recovery switch 312 for designating the cleaning operation of the printhead 203.

Sensors 313 sense the state of the apparatus. The sensors 313 include the encoder sensor 205 mounted on the carriage unit, a photointerrupter 314 for home position sensing, the above-described discharge failure sensor 315, and a voltage monitor 316 required to perform leakage detection.

A head driver 317 is a driver for driving printing elements 318 in the printhead 203 in accordance with print data or the like. The head driver 317 includes a shift register for arranging print data in accordance with the positions of the individual printing elements 318 of the printhead 203, and a latch circuit for performing latching at a proper timing. The head driver 317 further includes a logic circuit element for driving the printing elements 318 in synchronism with a driving timing signal, and a timing setting unit for appropriately setting the driving timing (discharge timing) in order to adjust the print position.

A motor driver 319 is a driver for driving a carriage motor 320. A motor driver 321 is a driver for driving a conveyance motor 322 for conveying a print medium. A motor driver 323 is a driver for driving a pump motor 324 mounted on the recovery unit 207.

Figure 4:
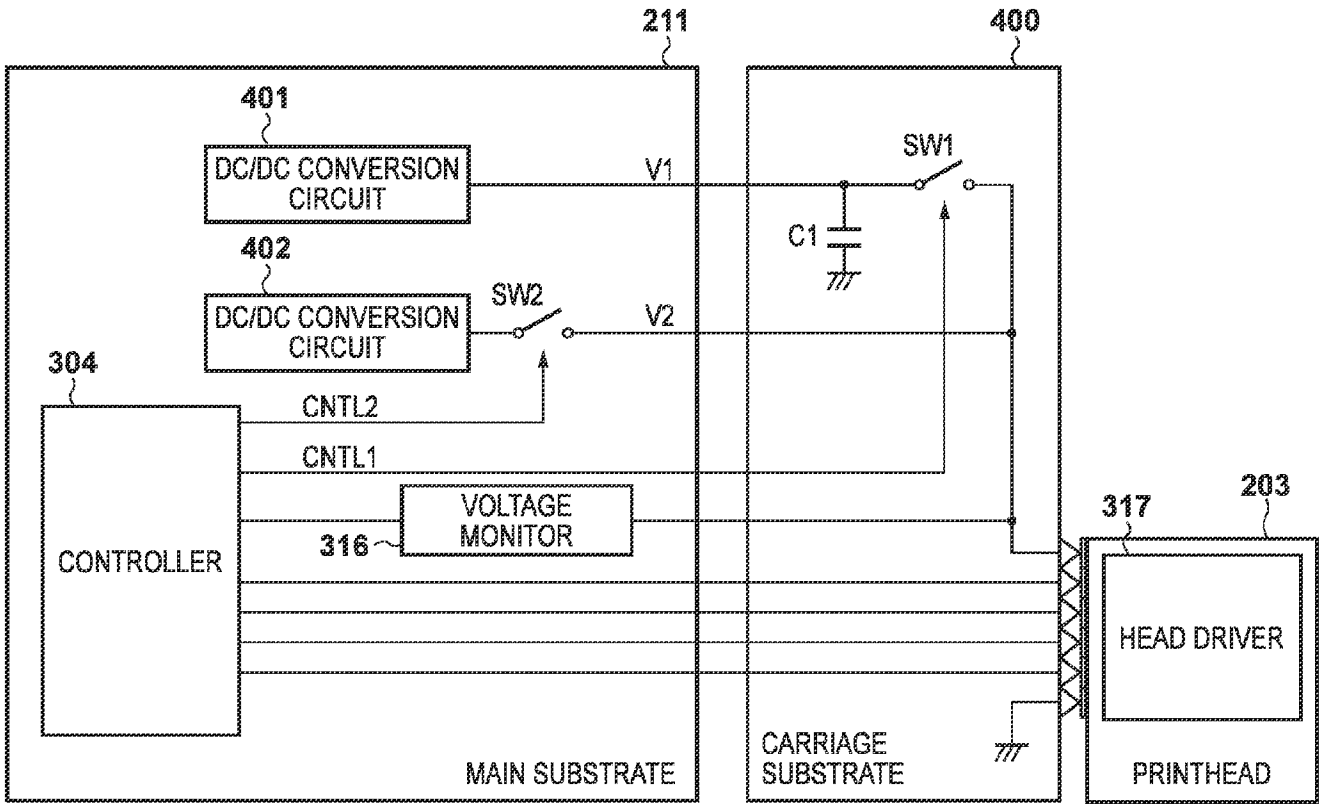
FIG. 4 is a block diagram for explaining an arrangement of printhead leakage detection to be executed by the printing apparatus.

FIG. 4 is a block diagram for explaining an arrangement of printhead leakage detection which is executed by the printing apparatus.

A circuit board incorporated into the printing apparatus roughly includes the main substrate 211 and a carriage substrate 400 mounted on the carriage unit 201. When the printhead 203 is attached to the carriage unit 201, the printhead 203 is electrically connected to the main substrate 211 via the carriage substrate 400 by using a contact. Electric power necessary for the operation of the printhead 203 is supplied to it via the flexible flat cable (FFC) 210 and carriage substrate 400.

In a normal printing operation as shown in FIG. 4, a first voltage (V1) to be applied to the printing element is supplied from the DC/DC conversion circuit 401 to the printhead 203 via the carriage substrate 400. Also, to stabilize the head voltage, an electrolytic capacitor (C1) having a large capacitance is connected parallel to a power line for supplying the first voltage (V1), between the power line and a ground (GND). In addition, in the carriage substrate 400, a first switch (SW1) formed by a semiconductor transistor or the like is inserted into a first power line for supplying the first voltage (V1). The first switch (SW1) can switch over ON/OFF of the application of the first voltage (V1) to the printhead 203. A first control signal (CNTL1) supplied from the controller 304 controls ON/OFF of the first switch (SW1). The first voltage is used to drive the printhead 203 in a normal printing operation.

On the other hand, a second voltage (V2) having an electric power supply capability lower than that of the first voltage (V1) is supplied to the printhead 203 via the carriage substrate 400 in order to perform leakage detection. The second voltage (V2) may be supplied from the AC/DC conversion circuit or DC/DC conversion circuit via a regulator, and may also be supplied from the DC/DC conversion circuit. As an example, the DC/DC conversion circuit 402 supplies the second voltage (V2) in FIG. 4. Note that V1=24 V and V2=20 V in this embodiment, but these voltages may also have other values.

A second switch (SW2) formed by a semiconductor transistor or the like is inserted into a second power line for supplying the second voltage (V2) as well. The second switch (SW2) can switch over ON/OFF of the application of the second voltage (V2) to the printhead 203. A second control signal (CNTL2) supplied from the controller 304 controls ON/OFF of the second switch (SW2).

A voltage monitor 316 monitors the voltages applied from the first and second power lines to the printhead 203 via the contacts, and outputs the monitoring result to the controller 304. Also, the controller 304 supplies signals for driving the printhead 203, for example, a print data signal, clock signal, and heat enable signal to the printhead 203 via the carriage substrate 400. Note that the main substrate 211 outside the carriage substrate 400 includes the head driver 317 and voltage monitor 316.

The above arrangement executes leakage detection on the printhead 203. Note that this arrangement shown in FIG. 4 executes leakage detection on one printhead, but leakage detection can similarly be performed in a printing apparatus integrating two printheads.

Figure 5A:
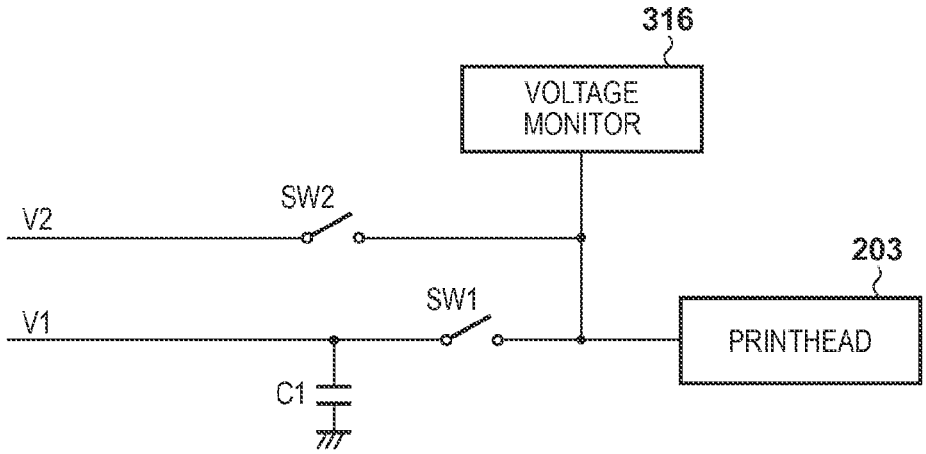
FIG. 5A is a block diagram showing a conceptual arrangement upon executing leakage detection on one printhead.

FIG. 5A is a block diagram showing a conceptual arrangement upon executing leakage detection on one printhead.

Figure 5B:
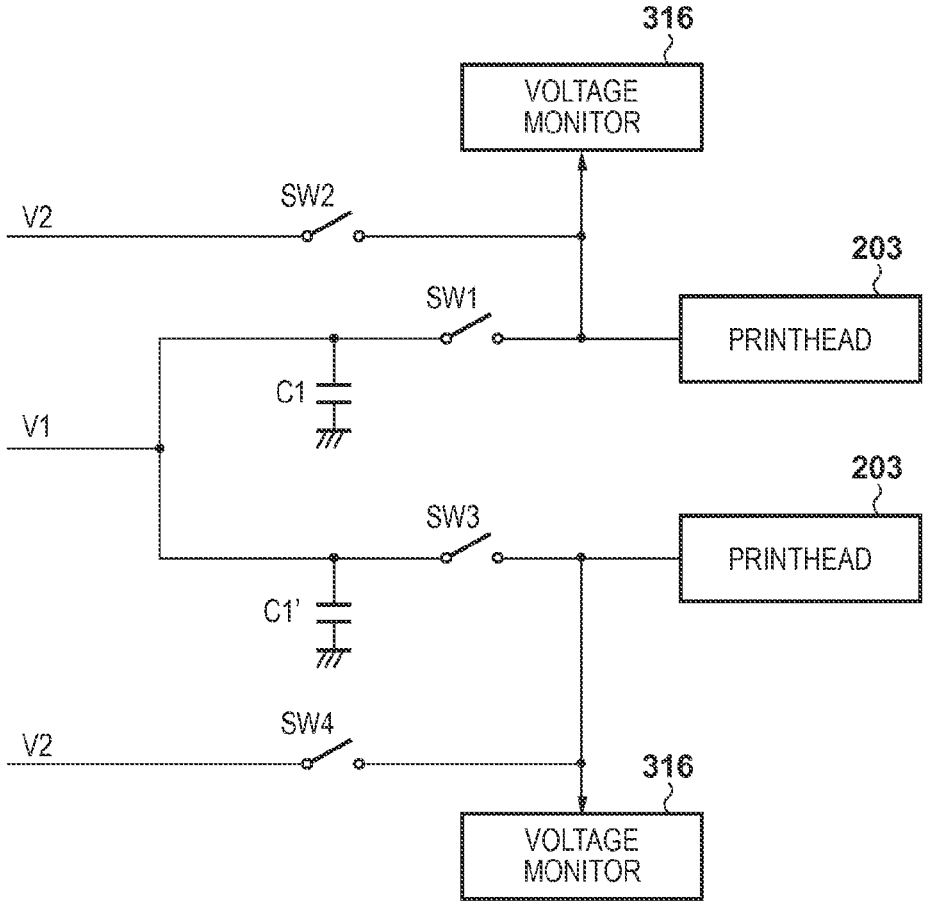
FIG. 5B is a block diagram showing a conceptual arrangement upon executing leakage detection on two printheads.

FIG. 5A shows the arrangement shown in FIG. 4 more conceptually. By contrast, FIG. 5B is a block diagram showing a conceptual arrangement upon executing leakage detection on two printheads. FIG. 5B shows an arrangement which applies the second voltage (V2) to the two printheads 203, and an arrangement in which switches SW3 and SW4 are added to be able to separately switch over the first voltage (V1) and second voltage (V2) for each printhead. In addition, two voltage monitors 316 monitor the voltages with respect to the two printheads.

Details of the leakage detection process using the printing apparatus having the above-described arrangement will now be explained.

Figure 6:
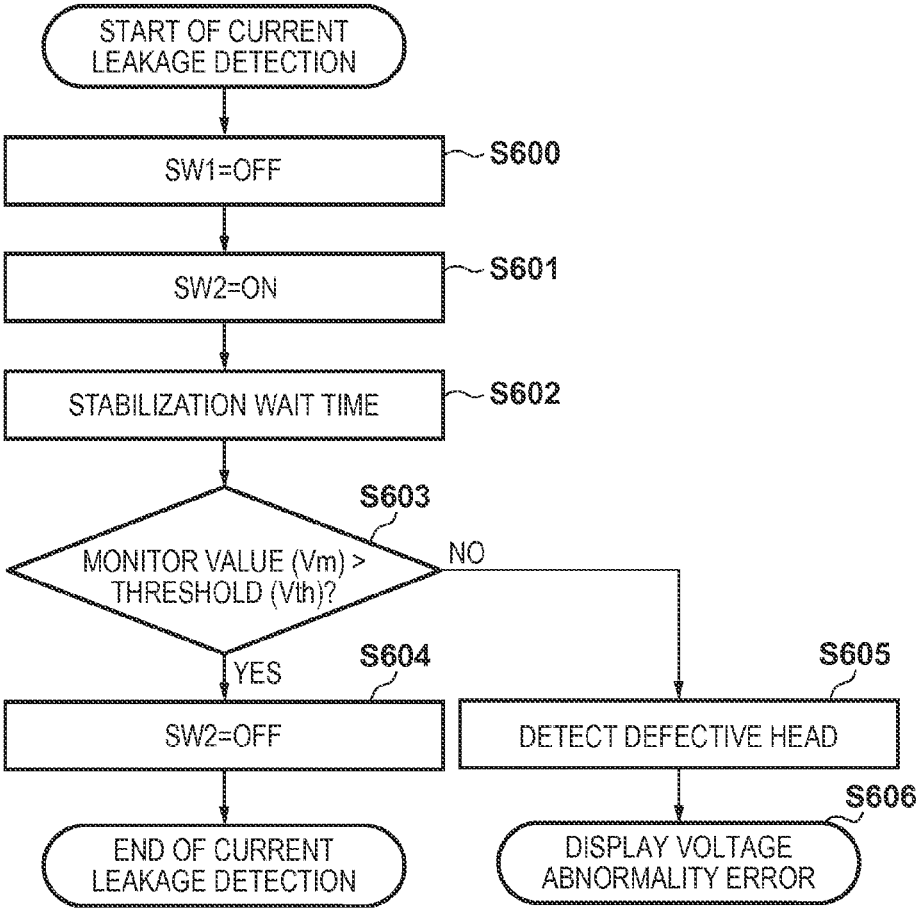
FIG. 6 is a flowchart showing the process of leakage detection.

FIG. 6 is a flowchart showing the leakage detection process. This process is performed by the CPU 305 by executing the control program stored in the ROM 306. This process is intermittently executed while the printing apparatus 100 is operating. The execution timing will be described later. The leakage detection process is executed in a state in which the printhead is attached.

First, the CPU 305 turns off the first switch (SW1) by the first control signal (CNTL1) in step S600, and turns on the second switch (SW2) by the second control signal (CNTL2) in step S601. Consequently, the second voltage (V2=20 V) is applied to the printhead 203 through the power line.

Then, in step S602, the CPU 305 waits for a predetermined time until the voltage stabilizes. This waiting time is about an order of 1 msec. After that, in step S603, the CPU 305 compares a monitor voltage (Vm) detected by the voltage monitor 316 with a predetermined threshold (Vth).

If Vm>Vth, the process advances to step S604. In step S604 as the last step, the CPU 305 turns off the second switch (SW2) by the second control signal (CNTL2), and terminates leakage detection.

On the other hand, if Vm≤Vth (equal to or less than the threshold), the process advances to step S605, and the CPU 305 determines that a failure has occurred in the printhead. Subsequently, in step S606, the CPU 305 displays a message indicating the occurrence of a current leakage on an LCD of the display panel 106, notifies the user of the abnormality of the printhead, and prompts the user to reattach or exchange the printhead. After that, the CPU 305 performs leakage error processing. Note that a warning process of, for example, turning on a specific lamp of the display panel 106 may also be performed. The error display process in step S606 can be executed not only on the printing apparatus but also on the host apparatus 308 connected to the printing apparatus.

Embodiments of the detailed current leakage detection process executed by the printing apparatus having the above arrangement will be explained below.

First Embodiment

A printing apparatus 100 performs printing by discharging ink from a printhead 203 while reciprocally moving a carriage unit 201 as described previously.

Figure 7:
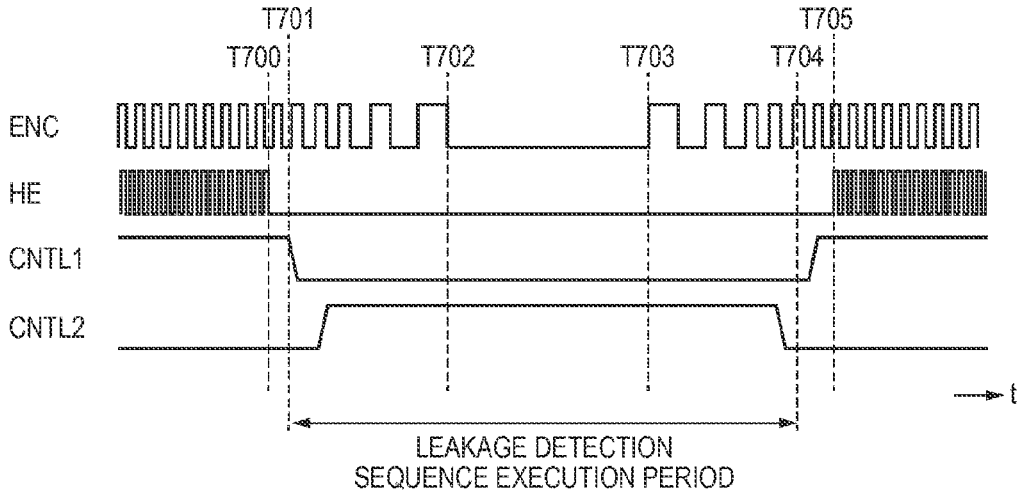
FIG. 7 is a timing chart showing a leakage detection sequence according to the first embodiment.

FIG. 7 is a timing chart showing a leakage detection sequence according to the first embodiment.

FIG. 7 shows an encoder sensor signal (ENC), and a head driver signal (HE), the first control signal (CNTL1), and the second control signal (CNTL2) from a controller 304 for driving the printhead 203, when the moving direction of the carriage unit 201 is reversed.

As shown in FIG. 7, printing corresponding to the width of the print medium ends at timing t=T700, and the head driver signal (HE) from the controller 304 stops. At almost the same time, the carriage unit 201 decelerates, and the period of the encoder sensor signal (ENC) prolongs. The carriage unit 201 completely stops at timing t=T702, and starts accelerating in the opposite direction at timing t=T703.

In this example shown in FIG. 7, the leakage detection sequence described earlier is started at timing t=T701 at which the carriage unit 201 starts decelerating. If the leakage detection sequence normally ends at timing t=T704 before ink discharge from the printhead 203 begins in the carriage movement in the opposite direction, the next control is performed. That is, at the end timing of the leakage detection sequence, the first switch (SW1, SW3) is turned on to supply the first voltage (V1) to the printhead 203 again. Then, the printing apparatus 100 performs printing on the print medium from timing t=T705.

As described above, the leakage detection sequence described previously is executed at the timing of reversal of the carriage unit 201 while printing is performed on the print medium.

As described earlier, the moving direction of the carriage unit 201 is reversed in the home position and back position. At the time of this reversal, preheat is performed by driving the printhead 203 in order to hold ink in the printhead 203 at a predetermined temperature.

Figure 8:
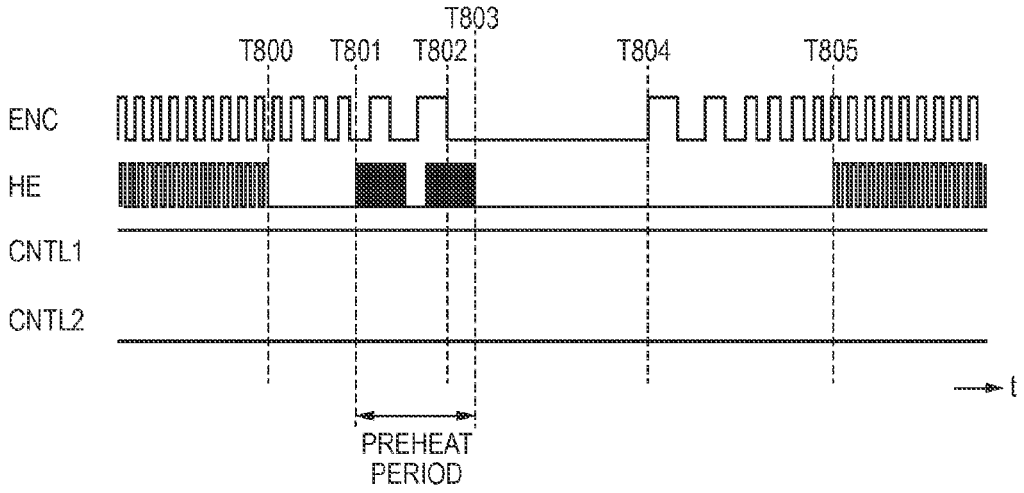
FIG. 8 is a timing chart showing the signal waveforms of an encoder sensor signal (ENC), head driver signal (HE), first control signal (CNTL1), and second control signal (CNTL2) upon executing preheat at the time of reversing the moving direction of a carriage unit.

FIG. 8 is a timing chart showing the signal waveforms of the encoder sensor signal (ENC), head driver signal (HE), first control signal (CNTL1), and second control signal (CNTL2), upon executing preheat when the moving direction of the carriage unit 201 is reversed.

Referring to FIG. 8, a period of timings t=T801 to T803 is the preheat period. This preheat is performed at the reversal timing of the carriage unit 201 in several initial scans during which the ink temperature is not so high. Although preheat is performed at the carriage reversal timing in the period of timings t=T801 to T803, if this preheat period is long, it becomes difficult to ensure the time of the leakage detection sequence described earlier. The leakage detection sequence is not executed when the printing speed may decrease if the leakage detection sequence is performed. Note that in FIG. 8, a timing T804 is an acceleration start timing of the printhead 203, and a timing T805 is a print start timing in backward printing.

As shown in FIG. 8, therefore, the second control signal (CNTL2) is not turned on in the preheat period because the leakage detection sequence is not executed. After the ink in the printhead 203 is sufficiently warmed up by preheat of several scans, the preheat period shortens, and a sufficient leakage detection time is ensured. If this is the case, the leakage detection sequence is executed when the carriage unit 201 is reversed as described previously. After the execution of the leakage detection sequence, preheat for maintaining the ink temperature in the printhead 203 is executed until the start of printing.

In the embodiment explained above, therefore, the leakage detection sequence can be executed at a proper timing when the carriage unit is reversed during a printing operation, without decreasing the printing speed of the printing apparatus.

Second Embodiment

In this embodiment, an example in which the leakage detection sequence is executed in a case where a jam of the print medium occurs during a printing operation will be explained.

Figure 9:
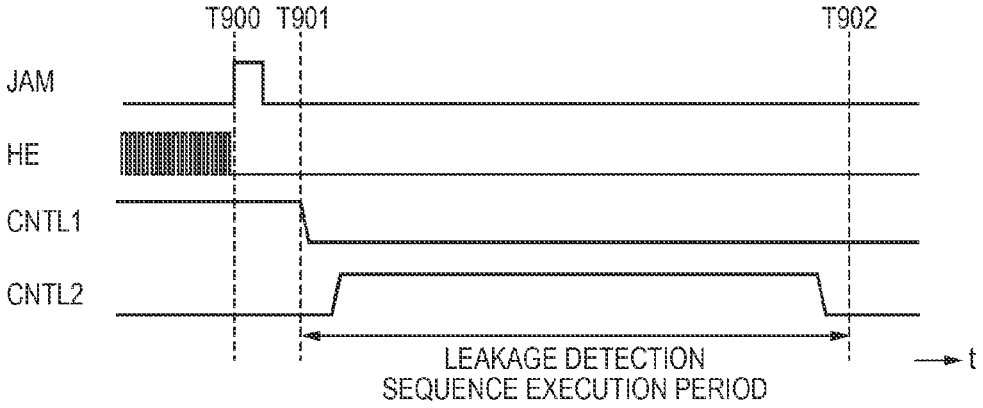
FIG. 9 is a timing chart showing a leakage detection sequence according to the second embodiment.

FIG. 9 is a timing chart showing a leakage detection sequence according to the second embodiment.

FIG. 9 shows a jam detection signal (JAM), and the head driver signal (HE), first control signal (CNTL1), and second control signal (CNTL2) from a controller 304, when a jam occurs in a printing apparatus 100 during a printing operation.

There is a case where the print medium is floated or folded on a platen 209, and a carriage unit 201 sometimes comes in contact with the print medium during a printing operation, thereby causing a jam. The occurrence of the jam may cause to damage the nozzle surface of a printhead 203, thereby damaging the printhead 203. The printing apparatus 100 has a function of sensing a jam by the above-described optical sensor 212 or the like. When sensing a jam, the optical sensor 212 outputs a jam sensing signal (JAM) indicating the occurrence of the jam to the controller 304. Note that this jam sensing signal (JAM) may also be a signal which is generated and recognized inside the controller 304 in accordance with an output signal from the optical sensor 212 or the like.

As shown in FIG. 9, if a jam is sensed at timing t=T900, the jam sensing signal (JAM) is turned on (to High level) and output. When the jam sensing signal (JAM) is detected, the controller 304 stops outputting the head driver signal (HE) at almost the same time. After that, the above-described leakage detection sequence is executed in a period of timings t=T901 to T902. If it is determined in this leakage detection sequence that abnormality has occurred in the printhead 203, the above-described leakage error processing is performed. On the other hand, if it is determined that the printhead 203 is normal, the printing apparatus 100 notifies the user of the occurrence of the jam by displaying a message on a display panel 106 or turning on a specific LED lamp.

In the embodiment explained above, therefore, if a printhead is damaged by a jam, leakage detection is immediately executed, so it is possible to immediately detect an abnormality of the printhead. This makes it possible to prevent a continuous use of the printhead in a defective state, and prevent defective printing by the printhead.

Third Embodiment

In this embodiment, an example in which the leakage detection sequence is executed when the printing apparatus is powered on or returns from a power saving mode to a normal mode will be explained.

Figure 10:
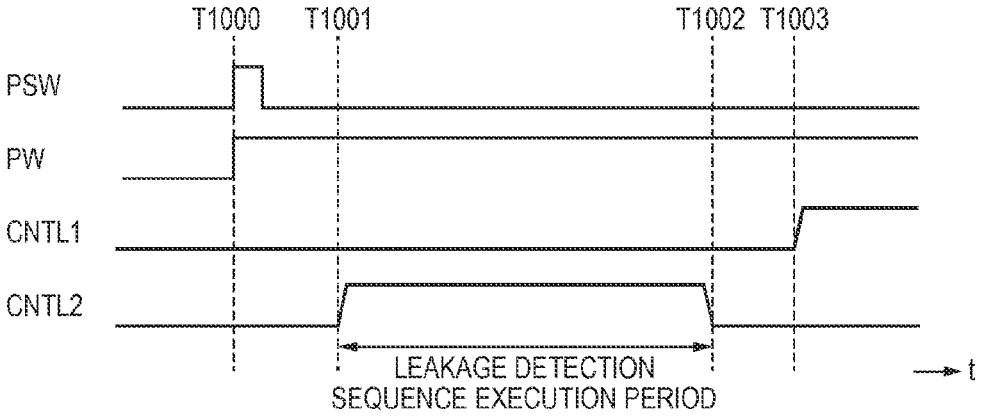
FIG. 10 is a timing chart showing a leakage detection sequence according to the third embodiment.

FIG. 10 is a timing chart showing a leakage detection sequence according to the third embodiment.

FIG. 10 shows the first control signal (CNTL1), the second control signal (CNTL2), a power switch (PSW) signal, and a printing apparatus main body system supply voltage (PW) when the printing apparatus main body is powered on or returns from the power saving mode.

As shown in FIG. 10, before the power source is turned on or in the power saving mode, the main body system supply voltage (PW) is not supplied to the printing apparatus main body system. After the power switch (PSW) is pressed by the user at timing t=T1000, the main body supply voltage (PW) rises, the printing apparatus enters the normal mode, and electric power is supplied to the main body main system. Then, the leakage detection sequence is executed at timings t=T1001 to T1002. If it is determined by the execution of this leakage detection sequence that a printhead 203 has an abnormality, the above-described leakage error processing is performed. On the other hand, if it is determined that the printhead 203 is normal, the first control signal (CNTL1) rises at timing t=T1003 in the example shown in FIG. 10. Consequently, the first switch (SW1) is turned on, and the first voltage (V1) is supplied to the printhead.

FIG. 10 shows the example in which after the power switch (PSW) is pressed by the user at timing t=T1000, the printing apparatus shifts from the power saving mode to the normal mode, and power supply to the main body main system is started. However, the present invention is not limited to this. For example, the leakage detection sequence may also be activated when the printing apparatus shifts from the power saving mode to the normal mode in accordance with an instruction from a host apparatus 308.

In the embodiment explained above, therefore, it is possible to immediately detect a state change after the printhead has not been used for a long time because the printing apparatus is powered off or has entered the power saving mode, and immediately determine the state of the printhead. In addition, it is possible to prevent defective printing by the printhead in a defective state.

Fourth Embodiment

In this embodiment, an example in which when starting an operation necessary for printing in accordance with a print instruction signal (HCNT) from a host apparatus 308, a controller 304 executes the leakage detection sequence before supplying the first voltage (V1) to a printhead 203 will be explained.

Figure 11:
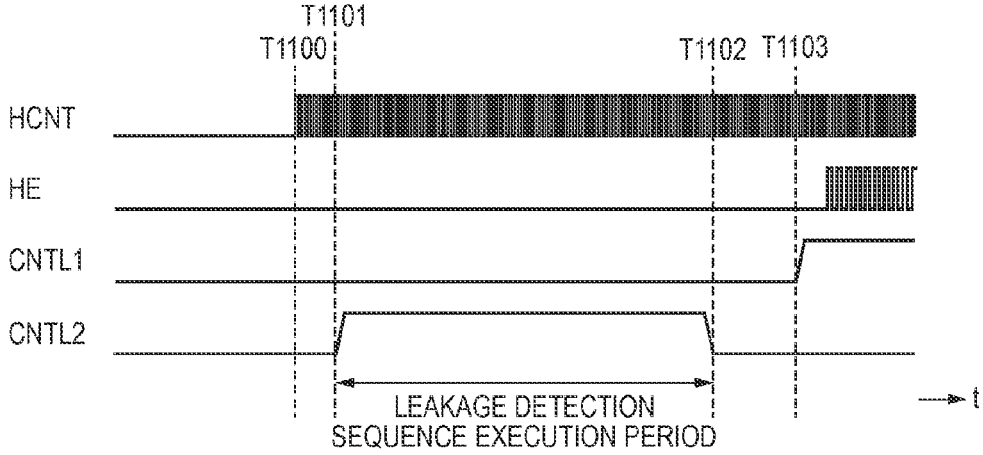
FIG. 11 is a timing chart showing a leakage detection sequence according to the fourth embodiment.

FIG. 11 is a timing chart showing a leakage detection sequence according to the fourth embodiment.

FIG. 11 shows the first control signal (CNTL1), the second control signal (CNTL2), the head driver signal (HE), and the print instruction signal (HCNT) from the host apparatus, before printing to the print medium is started.

As shown in FIG. 11, at timing t=T1100, the controller 304 receives the print instruction signal (HCNT) from the host apparatus 308, and starts the operation necessary for printing. After that, the leakage detection sequence is executed at timings t=T1101 to T1102. If it is determined by the execution of this leakage detection sequence that the printhead 203 has an abnormality, the above-described leakage error processing is performed. On the other hand, if the printhead is found to be normal, the first control signal (CNTL1) rises at timing t=T1103, and the first switch (SW1) is turned on. Consequently, the first voltage (V1) is supplied to the printhead 203, and a printing apparatus 100 starts a normal printing operation.

In the embodiment explained above, therefore, the leakage detection sequence to the printhead is executed before printing. This makes it possible to prevent defective printing by the printhead found to be defective.

Fifth Embodiment

In this embodiment, an example in which the leakage detection sequence is executed in a case where the printhead is exchanged will be explained.

Figure 12:
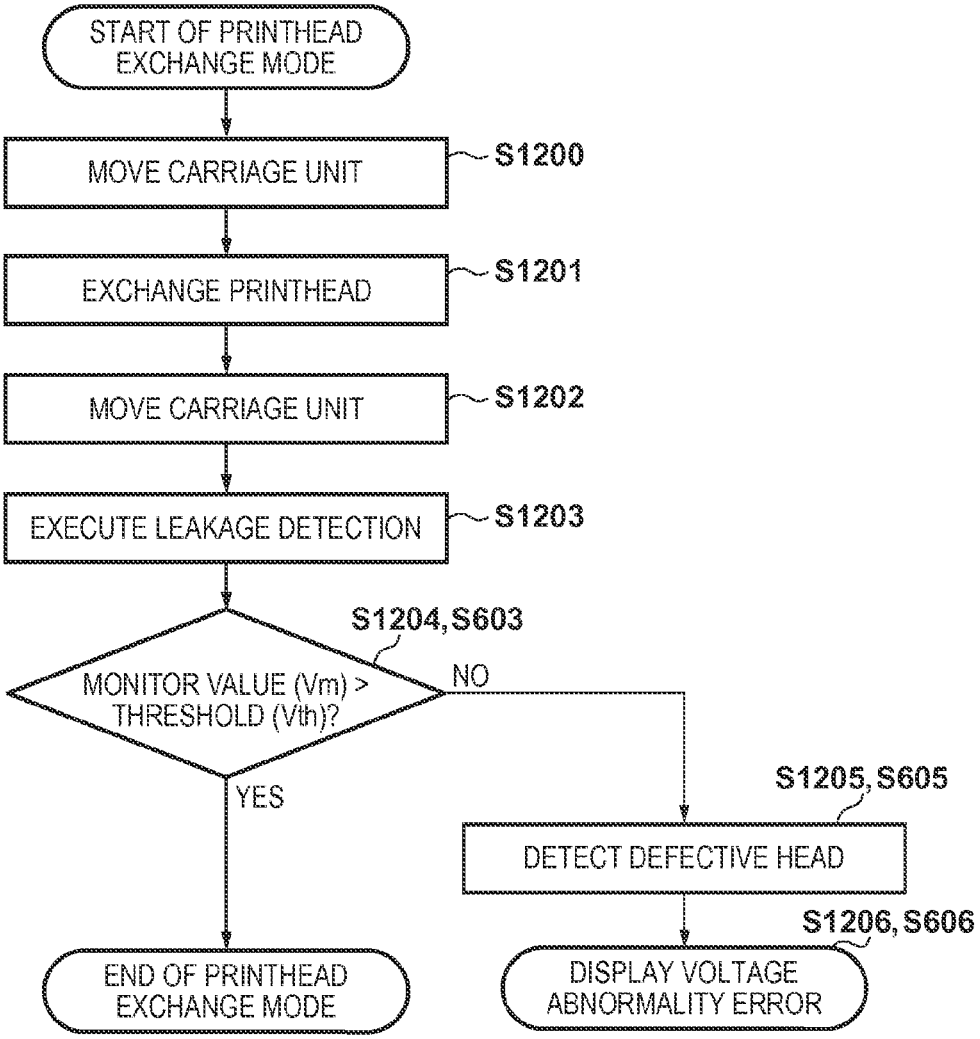
FIG. 12 is a flowchart showing a leakage detection sequence according to the fifth embodiment.

FIG. 12 is a flowchart showing a leakage detection sequence according to the fifth embodiment.

An operation of moving the carriage unit to a printhead exchange position upon exchanging the printhead is started when a sensor senses that the user has opened the upper cover, or when the user inputs a printhead exchange instruction from the operation panel 105.

When the printing apparatus 100 shifts to a printhead exchange mode, a carriage unit 201 moves to the printhead exchange position and displays a message for prompting printhead exchange on a display panel 106 in step S1200.

Then, in step S1201, the user exchanges the printhead by opening an upper cover 104, and closes the upper cover 104 after that. Subsequently, the carriage unit 201 moves to the home position in step S1202, and the leakage detection sequence is executed in step S1203.

Steps S1204 to S1206 as a sequence after that are the same as the leakage detection process in steps S603, S605, and S606 explained with reference to FIG. 6, so an explanation thereof will be omitted. If it is determined by this leakage detection process that the exchanged printhead is defective, a message indicating that a defective printhead is attached may be displayed on the display panel 106, or an LED indicating an error may be turned on. Alternatively, it is also possible to move the carriage unit 201 to the printhead exchange position again, and execute the sequence of prompting printhead exchange again.

In the embodiment explained above, therefore, the leakage detection sequence is executed upon exchanging the printhead. Accordingly, it is possible to determine whether the state of the newly attached printhead is good or bad, and prevent a print failure by the defective printhead.

Sixth Embodiment

In this embodiment, an example in which the leakage detection sequence is executed before or after the above-described cleaning sequence, or during the cleaning sequence will be explained.

Figure 13:
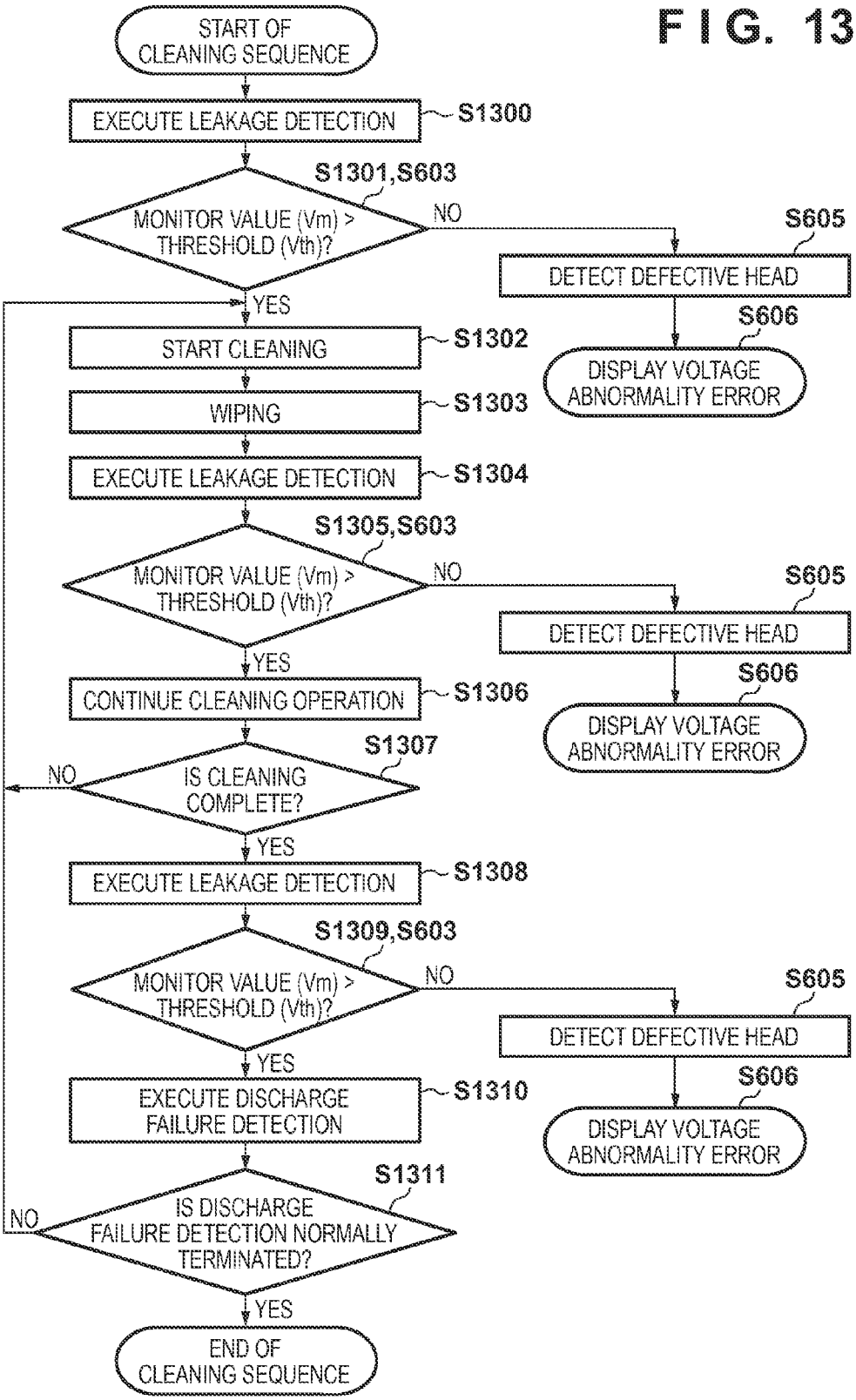
FIG. 13 is a flowchart showing a cleaning sequence including a leakage detection sequence according to the sixth embodiment.

FIG. 13 is a flowchart showing a cleaning sequence including a leakage detection sequence according to the sixth embodiment.

When the cleaning sequence is started, the leakage detection sequence is executed in step S1300, and the leakage detection result is determined in step S1301. In this step, the presence/absence of a leakage is determined comparing the monitor voltage (Vm) detected by a voltage monitor 316 with the predetermined threshold (Vth) as described previously. Processing after a defective printhead is detected by this determination has already been explained with reference to FIG. 6, so the same step reference numbers as in FIG. 6 denote the same steps in FIG. 13, and an explanation thereof will be omitted. Also, the cleaning sequence is immediately terminated when the defective printhead is detected by the execution of the leakage detection sequence.

If it is determined in step S1301 that the printhead is normal, the process advances to step S1302, and cleaning is started. This cleaning includes a process called wiping by which the nozzle surface of the printhead is cleaned by using a wiper. Wiping is executed in step S1303, and the leakage detection sequence is executed again in step S1304. This process is the same as step S1300. After that, in step S1305, the same leakage detection result determination process as in step S1301 is performed.

If it is determined in step S1305 that the printhead is normal, the process advances to step S1306 to continue the cleaning operation. In step S1307, whether the cleaning operation has ended is determined. If the cleaning operation has not ended, the process returns to step S1302. On the other hand, if the cleaning operation has ended, the process advances to step S1308, and the leakage detection sequence is executed again. This process is the same as step S1300.

In this embodiment as described above, the leakage detection sequence is executed whenever wiping is performed in the cleaning sequence, and the leakage detection sequence is executed even after cleaning. After that, in step S1309, the same leakage detection result determination process as in step S1301 is performed.

If it is determined in step S1309 that the printhead is normal, the process advances to step S1310, and a process (discharge failure detection) of detecting a discharge failure nozzle of the printhead is executed. If it is determined by the execution of discharge failure detection in step S1311 that the printhead includes a discharge failure nozzle, the process returns to step S1302, and the above-described cleaning sequence is executed. On the other hand, if it is determined that there is no discharge failure nozzle, the cleaning sequence is normally terminated.

In the embodiment explained above, therefore, the leakage detection sequence is executed before cleaning is started, and the cleaning operation for a defective printhead is omitted. This makes it possible to reduce the user's waiting time, and suppress unnecessary ink consumption by cleaning.

Also, the leakage detection sequence is executed immediately after wiping. Accordingly, a defective printhead can be detected immediately after the wiping operation which is a load on the printhead. Consequently, the cleaning operation after wiping is omitted if a defective printhead is attached. This makes it possible to reduce the user's waiting time, and suppress unnecessary ink consumption by cleaning.

Furthermore, since the leakage detection sequence is executed again after cleaning is complete, defective printing by a defective printhead can be prevented. In addition, no discharge failure detection is executed after cleaning while a defective printhead is attached. Accordingly, it is possible to reduce the user's waiting time, and suppress unnecessary ink consumption by discharge failure detection.

As described above, the leakage detection sequence is executed at a proper timing during the cleaning sequence. This makes it possible to suppress unnecessary ink consumption by a defective printhead, and immediately detect a defective printhead.

In each of the first to sixth embodiments explained above, the first switch (SW1) is always turned off when executing the leakage detection sequence as explained with reference to FIG. 6, so the large capacitor (C1 (C1') shown in FIG. 5B) is disconnected from the circuit. This contributes to increasing the processing speed because the time for charging electricity in the capacitor is unnecessary. Also, a voltage lower than a normal voltage is used when executing the leakage detection sequence. This contributes to decreasing the possibility of damage to the printhead, and implements safe process execution.

In addition, as described in each of the first to sixth embodiments, it is possible to detect a defective printhead early and prevent defective printing by executing the leakage detection sequence at a proper timing.

Note that a so-called, large-format printing apparatus which performs printing on an A0- or B0-size print medium is used in the embodiments explained above. However, the present invention is also applicable to printing apparatuses which perform printing on relatively small-sized print media such as A4, A3, B4, and B5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-064349, filed Mar. 26, 2014, which is hereby incorporated by reference herein in its entirety.

What is claimed is:

1. A printing apparatus comprising:

a carriage on which a printhead is mounted;

a moving unit configured to reciprocally move said carriage;

an encoder configured to detect a position of said carriage;

a supply unit configured to supply, to the printhead, one of a first voltage which is used to perform printing by the printhead through a first power line to which a capacitor is parallel-connected, and a second voltage, lower than the first voltage, which is used to detect a current leakage from the printhead through a second power line; and a monitor unit configured to monitor a voltage appearing on the second power line;

a control unit configured to execute a detection operation to detect the current leakage based on the voltage monitored by said monitor unit after turning off supply of the first voltage by said supply unit and turning on supply of the second voltage by said supply unit, wherein said control unit executes the detection operation at a timing at which a moving direction of said carriage is reversed by a signal from said encoder.

2. The apparatus according to claim 1, wherein the printhead is an inkjet printhead configured to perform printing by discharging ink on a print medium.

3. The apparatus according to claim 1, wherein said control unit includes a comparison unit configured to compare the voltage monitored by said monitor unit with a predetermined threshold, and said control unit determines that a current leakage has occurred if the monitored voltage is larger than the predetermined threshold.

4. The apparatus according to claim 3, further comprising a display unit configured to display the occurrence of the current leakage.

5. A printing apparatus comprising:

a carriage on which a printhead is mounted;

a supply unit configured to supply, to the printhead, one of a first voltage which is used to perform printing by the printhead through a first power line to which a capacitor is parallel-connected, and a second voltage, lower than the first voltage, which is used to detect a current leakage from the printhead through a second power line;

a monitor unit configured to monitor a voltage appearing on the second power line;

a control unit configured to execute a detection operation to detect the current leakage based on the voltage monitored by said monitor unit after turning off supply of the first voltage by said supply unit and turning on supply of the second voltage by said supply unit;

a conveyance unit configured to convey a print medium in a direction different from a moving direction of said carriage; and a sensor configured to sense whether a jam has occurred on the print medium due to conveyance by said conveyance unit, wherein said control unit executes the detection operation in accordance with a signal indicating the occurrence of a jam from said sensor.

6. A printing apparatus comprising:

a carriage on which a printhead is mounted;

a supply unit configured to supply, to the printhead, one of a first voltage which is used to perform printing by the printhead through a first power line to which a capacitor is parallel-connected, and a second voltage, lower than the first voltage, which is used to detect a current leakage from the printhead through a second power line;

a monitor unit configured to monitor a voltage appearing on the second power line;

a control unit configured to execute a detection operation to detect the current leakage based on the voltage monitored by said monitor unit after turning off supply of the first voltage by said supply unit and turning on supply of the second voltage by said supply unit;

an openable cover; and an operation panel by which a user inputs a printhead exchange instruction to the printing apparatus, wherein said control unit executes the detection operation in a case where said cover is opened or the printhead exchange instruction is input.

7. The apparatus according to claim 6, further comprising a moving unit configured to reciprocally move said carriage, wherein in a case where said cover is opened or the printhead exchange instruction is input from said operation panel, the printhead is moved to a printhead exchange position by said moving unit.

8. A printing apparatus comprising;

a carriage on which a printhead is mounted;

a supply unit configured to supply, to the printhead, one of a first voltage which is used to perform printing by the printhead through a first power line to which a capacitor is parallel-connected, and a second voltage, lower than the first voltage, which is used to detect a current leakage from the printhead through a second power line;

a monitor unit configured to monitor a voltage appearing on the second power line;

a control unit configured to execute a detection operation to detect the current leakage based on the voltage monitored by said monitor unit after turning off supply of the first voltage by said supply unit and turning on supply of the second voltage by said supply unit;

a recovery unit configured to perform a cleaning operation of the printhead; and a discharge failure detection unit configured to detect whether the printhead includes a discharge failure nozzle, wherein said control unit executes the detection operation at a start and end of the cleaning operation.

9. The apparatus according to claim 8, wherein said control unit executes the detection operation in a case where a wiping operation of the cleaning operation starts.

10. The apparatus according to claim 8, wherein said control unit executes the detection operation before said discharge failure detection unit executes discharge failure detection.

11. A leak detection method of a printing apparatus including a carriage on which a printhead is mounted, comprising:

monitoring a voltage appearing on a second power line which supplies, to the printhead, a second voltage which is used to detect a current leakage from the printhead and lower than a first voltage which is supplied to perform printing by the printhead through a first power line to which a capacitor is parallel-connected;

controlling to execute a detection operation to detect the current leakage based on the monitored voltage, by turning off supply of the first voltage and turning on supply of the second voltage; and detecting a position of the carriage, which is reciprocally moved, by using an encoder, wherein in the controlling, the detection operation is executed at a timing at which a moving direction of the carriage is reversed by a signal from the encoder.

* * * * *